US006980170B2

(12) United States Patent
Geen

(10) Patent No.: US 6,980,170 B2
(45) Date of Patent: Dec. 27, 2005

(54) CO-LOCATED ANTENNA DESIGN

(75) Inventor: David Geen, Scotland (GB)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/484,572

(22) PCT Filed: Sep. 12, 2002

(86) PCT No.: PCT/US02/28991

§ 371 (c)(1),
(2), (4) Date: Aug. 16, 2004

(87) PCT Pub. No.: WO03/026173

PCT Pub. Date: Mar. 27, 2003

(65) Prior Publication Data

US 2004/0257289 A1 Dec. 23, 2004

Related U.S. Application Data

(66) Substitute for application No. 60/322,343, filed on Sep. 14, 2001.

(51) Int. Cl.[7] ..... H01Q 13/00
(52) U.S. Cl. ..... 343/781 CA; 343/781 P
(58) Field of Search ..... 343/772, 781 P, 343/781 R, 781 CA, 837

(56) References Cited

U.S. PATENT DOCUMENTS

| | | | | |
|---|---|---|---|---|
| 3,500,419 A | | 3/1970 | Leitner et al. | |
| 3,710,341 A | | 1/1973 | Sciambi, Jr. | 343/779 |
| 3,983,560 A | | 9/1976 | MacDougall | 343/781 CA |
| 4,034,378 A | | 7/1977 | Ohm | 343/781 |
| 4,236,161 A | * | 11/1980 | Ohm | 343/781 CA |
| 4,489,331 A | | 12/1984 | Salvat et al. | 343/753 |
| 4,595,929 A | * | 6/1986 | Kreutel, Jr. | 343/781 P |
| 4,612,550 A | | 9/1986 | Brucker et al. | 343/756 |
| 5,198,827 A | * | 3/1993 | Seaton | 343/761 |
| 5,546,097 A | * | 8/1996 | Ramanujam et al. | 343/781 R |
| 5,859,619 A | | 1/1999 | Wu et al. | 343/781 CA |
| 6,211,834 B1 | * | 4/2001 | Durham et al. | 343/781 P |
| 6,225,961 B1 | | 5/2001 | Benjauthrit | 343/839 |
| 6,225,964 B1 | * | 5/2001 | Fermelia et al. | 343/909 |
| 6,239,763 B1 | | 5/2001 | Cuchanski | 343/781 P |
| 6,307,523 B1 | * | 10/2001 | Green et al. | 343/781 CA |
| 6,342,865 B1 | * | 1/2002 | Chandler et al. | 343/781 CA |
| 6,424,310 B1 | * | 7/2002 | Broas et al. | 343/781 P |

FOREIGN PATENT DOCUMENTS

| | | |
|---|---|---|
| GB | 2 031 655 A | 4/1980 |
| JP | 59063804 A | 4/1984 |

OTHER PUBLICATIONS

International Search Report.
Intellectual Property Concerns, Inc.—Search Report dated Jun. 12, 2002—Three (3) Pages.

* cited by examiner

*Primary Examiner*—Shih-Chao Chen
(74) *Attorney, Agent, or Firm*—Welsh & Katz, Ltd.

(57) ABSTRACT

A method and apparatus are provided for transceiving signals. The method includes the steps of providing a secondary reflector within a focal region of a main reflector in a relative spatial relationship where a first radio frequency signal processed by a first radio frequency radiator adjacent the secondary reflector is reflected from both the secondary and main reflectors and providing a second radio frequency radiator in a aperture of the secondary reflector so that a second radio frequency signal processed by the second radio frequency transceiver is reflected from the main antenna along a path that is substantially coaxial with the first radio frequency signal.

26 Claims, 2 Drawing Sheets

CO-LOCATED ANTENNA DESIGN

CROSS REFERENCE TO RELATED APPLICATIONS

This application claims the benefit of priority from co-pending U.S. Provisional Patent Application Ser. No. 60/322,343 filed on Sep. 14, 2001, entitled Multi-Beam Co-Located Antenna. Provisional patent application Ser. No. 60/322,343 is incorporated herein by reference in its entirety.

FIELD OF THE INVENTION

The field of the invention relates to communication systems and more particularly to antenna used for satellite communication.

BACKGROUND OF THE INVENTION

Satellite communication systems are known and generally well understood. Such systems are typically used in telephone and data communications over long distances.

Satellite communication systems are typically used in conjunction with one or more ground stations. Ground stations are usually constructed as high value subsystems able to combine and disperse communication signals routed through the satellite.

Because of the volume of signal traffic typically processed by ground stations, signal traffic may be divided among relatively large numbers of carrier signals. Relatively large dish antenna are often provided to transceive those signals with the satellite.

In more recent periods, smaller, special purpose systems have been developed for transceiving signals with satellites. One example of such a system is the Very Small Aperture Terminal (VSAT) used for the communication of data, voice and video signals, except broadcast television.

A VSAT may include a transceiver and antenna (placed outdoors in direct line of sight with the satellite) and an interface unit. The interface unit is typically placed indoors and functions to interface the transceiver with end-user equipment.

One application of VSAT is an Internet/Satellite TV system that provides combined satellite TV and Internet services. The Internet/Satellite TV system interacts with two co-located or close-located satellites. A first satellite may provide two-way Internet access. Internet messages may be received in the 20 GHz band and transmitted on the 30 GHz band.

The second co-located or close-located satellite may provide satellite TV. The second satellite may transmit satellite TV in the 12 GHz band.

While the Internet/satellite TV system works well, the three different carriers of 12, 20 and 30 GHz are typically transceived through relatively expensive feed networks (e.g., three separate antenna) or frequency selective surface (FSS) techniques. The use of feed networks or FSS techniques is expensive and esthetically unacceptable in a consumer environment. Accordingly, a need exists for an antenna system that is compact and conveniently mounted to an exterior of an end-user's home.

DETAILED DESCRIPTION OF AN ILLUSTRATED EMBODIMENT

Figure 1:
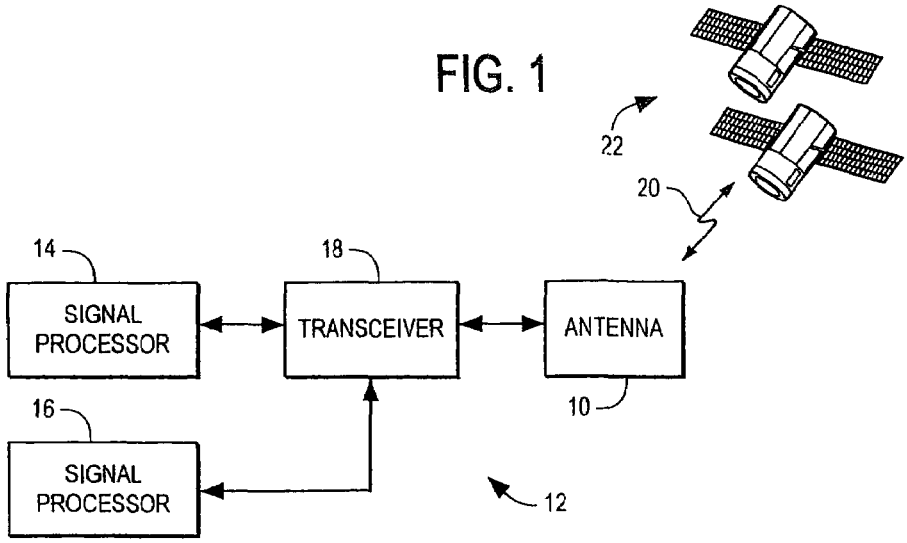
FIG. 1 depicts an antenna assembly in a context of use under an illustrated embodiment of the invention.

FIG. 1 is a block diagram of a multi-channel satellite communication system 12, shown generally under an illustrated embodiment of the invention. The system 12 may include a transceiver 18 and antenna 10 that exchanges a plurality of signals 20 with a plurality of co-located satellites 22.

Signals 20 may be received from the satellites 22 by the transceiver 18 and be distributed to a number of signal processors 14, 16. In the case of an Internet/satellite TV system, a first signal processor 14 may be a computer terminal that, in turn, would return signals 20 back to the satellites 22. A second signal processor 16 may be a satellite TV receiver.

Figure 2:
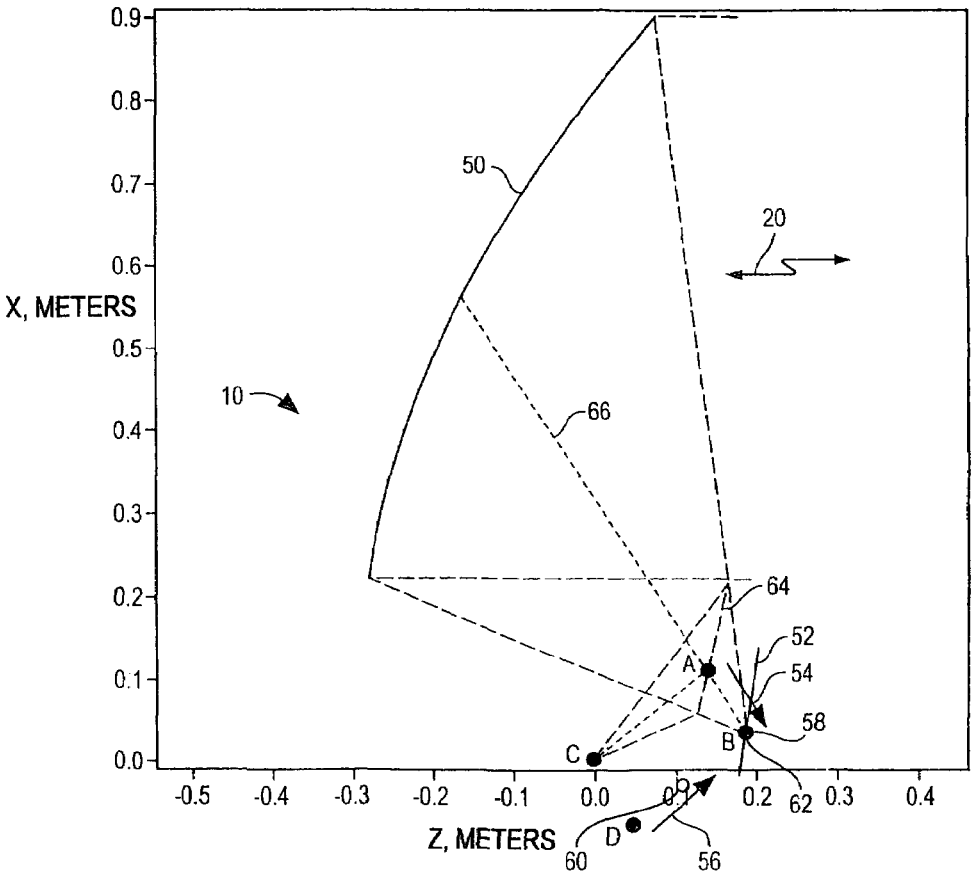
FIG. 2 depicts a side view of the antenna of FIG. 1.

FIG. 2 is a schematic side view of an antenna 10 adapted to operate in three different frequency ranges (e.g., 12, 20 and 30 GHz). More specifically, FIG. 2 shows an appropriately sized antenna (e.g., 0.68 meter (m)) with a Cassegrain, dual offset geometry.

The antenna 10 includes a main reflector 50 and a secondary reflector 52. The main reflector 50 may be parabolic or an adjusted parabola. Where the main reflector 50 is a parabola or an adjusted parabola it may have a focal region labeled "B" in FIG. 2.

The secondary reflector 52 may be an ellipsoid, hyperbolic, flat or any modified shape close to these shapes. An aperture 62 may be provided in a center region of the secondary reflector 52 in which a first radio frequency radiator 58 (e.g., a horn, waveguide, dielectric rod, etc.) is installed. It should be understood that, as used herein, the term "radiator" means a structure that is inherently capable of transmitting and/or receiving radio frequency energy. It should also be understood that while the first radio frequency radiator is disposed within the secondary reflector 52, the phrase "disposed within" is also meant to include the situation where the end of the radiator extends beyond the reflecting surface of the reflector 52 or is recessed into the aperture of the reflector 52.

The first radio frequency radiator 58 may be arranged to operate in a single offset (SO) mode in which it transmits and/or receives (processes) radio frequency energy that is reflected by the main reflector 50. In the case where the system 12 is an Internet/Satellite TV system, the first radio frequency radiator 58 may transmit in the 30 GHz region and receive in the 20 GHz region.

A second radio frequency radiator 60 may be provided adjacent the secondary reflector 52. The second radio frequency radiator 60 may be arranged to work in a dual-offset (DO) mode in which radio frequency energy processed by the radiator 52 is reflected from both the main reflector 50 and secondary reflector 52. In the case where the system 12 is an Internet/Satellite TV system, the second radio frequency radiator 60 may receive satellite TV in the 12 GHz region.

It should be noted that the second radio frequency radiator 60 is adjacent to and offset from the secondary reflector 52. As used herein, offset means to one side of a line extending between centerpoints of the main and secondary reflectors. It should also be noted that the reflecting surface of the secondary antenna 52 is disposed at an oblique angle with respect to the reflecting surface of the main reflector 50 to allow a signal processed by the second radio frequency radiator 60 to follow a zig-zag path between the satellite and second radio frequency radiator 60.

For purposes of explanation, the size and relationships of the elements of the antenna 10 will be described in the context of a Internet/Satellite TV system. It should be understood, however, that the concepts described herein may be applied to any directional antenna of the type described herein.

Figure 3:
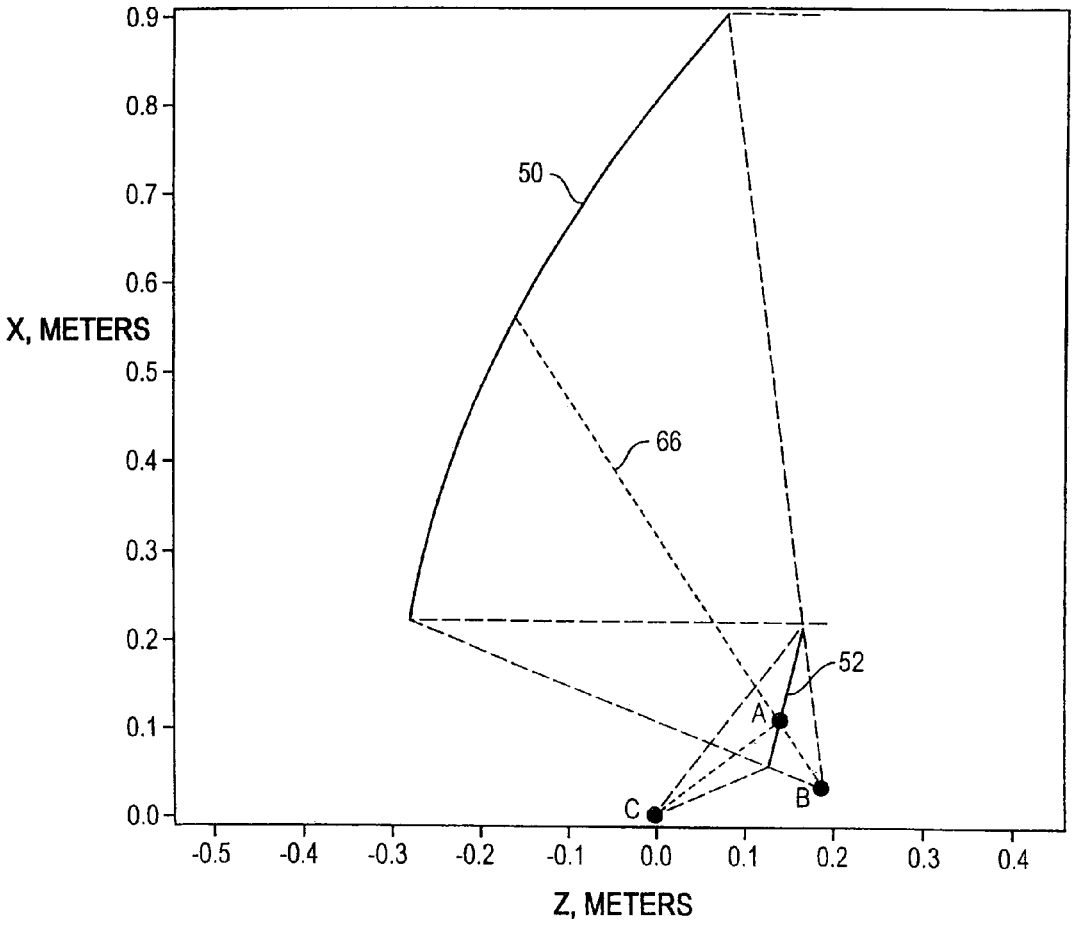
FIG. 3 depicts an explanatory version of the antenna of FIG. 2.

To understand the construction and operation of the antenna 10 of FIG. 2, reference may be made to FIG. 3. FIG. 3 shows a Cassegrain, dual-offset geometry for a 0.68 m antenna. The dots labeled "B" and "C" indicate the focal regions of the reflectors 50, 52, point C being a focal region of a signal reflecting off the main reflector 50 and secondary reflector 52 and point B being the focal region of the main reflector.

One concept for the construction of an antenna with co-located or close-located beams (coaxial beams) at 12, 20 and 30 GHz would be to place a 12 GHz feed at point C (FIG. 3) working in DO mode and a 20/30 GHz feed at point B working in SO mode. For the Ka band portion to work, it is assumed that a hole is provided in the secondary reflector 52 through which the Ka feed will radiate.

As would be apparent to those of skill in the art, the a dual mode antenna such as that shown in FIG. 3 could not work because the secondary reflector (labeled 52 in FIG. 3) would block any signal focused from the main reflector 50 into point B. To alleviate this difficulty, the secondary reflector 52 (FIG. 3) and feed C are translated along the line 66 running from the center of the main reflector 50 to its focal point B. The translation is shown by arrow 54 (FIG. 2) such that point A moves to point B and point C moves to point D. The distance from A to B is approximately 90 mm.

Further improvements can be achieved by moving the feed (now labeled D) closer to the secondary reflector 52, as indicated by arrow 56 in FIG. 2. Moving the feed D approximately 100 mm from point D to the position of the dot 60 provides the final arrangement of FIG. 2. In general, substantial advantages in antenna design, both in terms of reduced size and increased gain, may be achieved as depicted by FIGS. 2 and 3 by moving the relative positions of the antenna reflectors 50, 52 and feeds 58, 60 in order to optimize antenna gain.

The antenna 10 may be constructed and used under a number of different formats. For example, the subreflector 52 may be fabricated as a hyperboloid (for use with the Cassegrain configuration described above) or as an ellipsoid (for use in a Gregorian configuration).

The secondary reflector 52 may also be flat or fabricated in some other intermediate configuration. The main reflector 50 may be adjusted from a parabolic shape to an adjusted parabolic shape to complement any one of the range of shapes of the secondary reflector 52. Alternatively, the secondary reflector 52 may assume an adjusted ellipsoid/hyperboloid shape to complement any one of the range of shapes that the main reflector 50 may assume.

Using the concepts described above, a multi-beam co-located or close-located antenna may be fabricated and used in any of a number of different frequency ranges. The placement of a feed in an aperture of the secondary reflector and adjustment of the position of the secondary reflector allows the antenna 10 to be provided in a size range that is considerably smaller and easier to fabricate than prior antenna.

A specific embodiment of a method and apparatus for transceiving signals according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

What is claimed is:

1. A method of transceiving signals comprising the steps of:

providing a secondary reflector within a focal region of a main reflector with a reflecting surface of the secondary reflector disposed at an oblique angle with respect to a reflecting surface of the main reflector and in a relative spatial relationship where a first radio frequency signal processed by a first radio frequency radiator adjacent the secondary reflector is reflected from both the secondary and main reflectors; and providing a second radio frequency radiator in an aperture of the secondary reflector so that a second radio frequency signal processed by the second radio frequency radiator passes through the aperture of the secondary reflector and is reflected from the main antenna along a path that is substantially coaxial with at least a portion of a path of the first radio frequency signal.

2. The method of transceiving signals as in claim 1 wherein the first radio frequency signal processed by the first radio frequency radiator further comprises transmitting the first radio frequency signal to the main and secondary reflectors from the first radio frequency radiator.

3. The method of transceiving signals as in claim 1 wherein the first radio frequency signal processed by the first radio frequency radiator further comprises receiving the first radio frequency signal from the main and secondary reflectors by the first radio frequency radiator.

4. The method of transceiving signals as in claim 1 wherein the second radio frequency signal processed by the second radio frequency radiator further comprises transmitting the second radio frequency signal to the main and secondary reflectors from the second radio frequency radiator.

5. The method of transceiving signals as in claim 1 wherein the second radio frequency signal processed by the second radio frequency radiator further comprises receiving the second radio frequency signal from the main and secondary reflectors by the second radio frequency radiator.

6. The method of transceiving signals as in claim 1 wherein the second radio frequency signal processed by the second radio frequency radiator further comprises transceiving the second radio frequency signal between the main and secondary reflectors and the second radio frequency radiator.

7. The method of transceiving signals as in claim 1 wherein the relative spatial relationship of the main and secondary reflectors and first and second radio frequency radiators further comprise a Cassegrain antenna.

8. The method of transceiving signals as in claim 1 wherein the relative spatial relationship of the main and secondary reflectors and first and second radio frequency radiators further comprise a Gregorian antenna.

9. The method of transceiving signals as in claim 1 wherein the secondary reflector further comprises an ellipsoid reflecting surface.

10. The method of transceiving signals as in claim 1 wherein the secondary reflector further comprises a hyperbolic reflecting surface.

11. The method of transceiving signals as in claim 1 wherein the secondary reflector further comprises a flat reflecting surface.

12. The method of transceiving signals as in claim 1 further comprising adjusting a reflecting surface of the main antenna to complement a reflecting surface of the secondary reflector.

13. An apparatus for transceiving signals comprising:

a main reflector;

a secondary reflector disposed within a focal region of a main reflector with a reflecting surface of the secondary reflector disposed at an oblique angle with respect to a reflecting surface of the main reflector and in a relative spatial relationship where a first radio frequency signal processed by a first radio frequency radiator adjacent the secondary reflector is reflected from both the secondary and main reflectors;

the first radio frequency radiator; and a second radio frequency radiator in an aperture of the secondary reflector so that a second radio frequency signal processed by the second radio frequency radiator passes through the aperture of the secondary reflector and is reflected from the main antenna along a path that is substantially coaxial with the first radio frequency signal.

14. The apparatus for transceiving signals as in claim 13 wherein the first radio radiator further comprises a radio frequency transmitter.

15. The apparatus for transceiving signals as in claim 13 wherein the first radio radiator further comprises a radio frequency receiver.

16. The apparatus for transceiving signals as in claim 13 wherein the second radio radiator further comprises a radio frequency transmitter.

17. The apparatus for transceiving signals as in claim 13 wherein the second radio radiator further comprises a radio frequency receiver.

18. The apparatus for transceiving signals as in claim 13 wherein the second radio radiator further comprises a radio frequency transceiver.

19. The apparatus for transceiving signals as in claim 13 further comprising a Cassegrain antenna.

20. The apparatus for transceiving signals as in claim 13 further comprising a Gregorian antenna.

21. The apparatus for transceiving signals as in claim 13 wherein the secondary reflector further comprises an ellipsoid reflecting surface.

22. The apparatus for transceiving signals as in claim 13 wherein the secondary reflector further comprises a hyperbolic reflecting surface.

23. The apparatus for transceiving signals as in claim 13 wherein the secondary reflector further comprises a flat reflecting surface.

24. The method of transceiving signals as in claim 13 wherein the main reflector further comprises an adjusted reflecting surface adapted to complement a reflecting surface of the secondary reflector.

25. A method of constructing a multi-band antenna comprising the steps of:

providing a secondary reflector within a focal region of a main reflector in a relative spatial relationship where a first radio frequency signal exchanged with a first radio frequency transceiver adjacent the secondary reflector is reflected from both the secondary and main reflectors; and providing a second radio frequency transceiver in a aperture within the secondary reflector so that a second radio frequency signal transceived by the second radio frequency transceiver is reflected from the main antenna along a path that is substantially coaxial with the first radio frequency signal.

26. A method of constructing a multi-band antenna comprising the steps of:

providing a main reflector with a focal region located a predetermined distance from the main reflector;

disposing a first radio frequency radiator within the focal region of the main reflector with a predominant axis of radiation directed towards the main reflector;

disposing a secondary reflector within the focal region with the radio frequency radiation of the radio frequency radiator radiating towards the main reflector through an aperture in the secondary reflector;

disposing a second radio frequency radiator adjacent the secondary reflector with a predominant axis of radiation of the second radio frequency radiator directed towards the secondary reflector and wherein said secondary reflector and second radio frequency radiator are oriented so as to transmit radiation reflected from the secondary reflector towards the main reflector along a path that is substantially coaxial with radiation from the first radio frequency radiator.

* * * * *